US007448171B1

(12) United States Patent
diGirolamo et al.

(10) Patent No.: US 7,448,171 B1
(45) Date of Patent: Nov. 11, 2008

(54) JOIST SUPPORT STRUCTURE ADAPTED TO BE EMBEDDED INTO A FOUNDATION WALL

(75) Inventors: Edward R. diGirolamo, Raleigh, NC (US); Michael L. Torres, Raleigh, NC (US); Milan Dragic, Wake Forest, NC (US)

(73) Assignee: The Steel Network, Inc., Raleigh, NC (US)

( * ) Notice: Subject to any disclaimer, the term of this patent is extended or adjusted under 35 U.S.C. 154(b) by 389 days.

(21) Appl. No.: 11/259,926

(22) Filed: Oct. 27, 2005

(51) Int. Cl.
*E04B 7/04* (2006.01)

(52) U.S. Cl. ..... 52/92.2; 52/702; 52/712; 52/562; 287/20.94; 248/215

(58) Field of Classification Search ..... 52/289, 52/702, 712, 92.2, 699, 714, 7.15, 715, 562; 287/20.94; 248/215
See application file for complete search history.

(56) References Cited

U.S. PATENT DOCUMENTS 1,199,077 A * 9/1916 James ..... 249/210
1,578,947 A * 3/1926 Alber ..... 52/370
1,589,356 A * 6/1926 Brooks ..... 52/370
1,662,645 A * 3/1928 Lampert ..... 52/370
2,080,876 A * 5/1937 Reed ..... 52/345
3,420,019 A * 1/1969 Padilla ..... 52/238.1
3,422,585 A * 1/1969 Dismukes ..... 52/127.3
3,750,360 A * 8/1973 Kingston ..... 52/714
3,867,802 A * 2/1975 Murphy ..... 52/481.1
3,889,441 A * 6/1975 Fortine ..... 52/715
3,998,026 A * 12/1976 Allen ..... 52/714
4,041,668 A * 8/1977 Jahn et al. ..... 52/506.09
4,422,279 A * 12/1983 Powell ..... 52/745.12
4,527,375 A * 7/1985 Braginetz ..... 52/712
4,592,186 A * 6/1986 Braginetz ..... 52/699
4,656,794 A * 4/1987 Thevenin et al. ..... 52/22
4,924,648 A * 5/1990 Gilb et al. ..... 52/295
4,976,075 A * 12/1990 Kaveckis et al. ..... 52/71
5,467,569 A * 11/1995 Chiodo ..... 52/713
5,575,130 A * 11/1996 Chiodo ..... 52/713
6,526,721 B1 * 3/2003 Nash ..... 52/677
6,857,240 B1 * 2/2005 MacAlister ..... 52/564
7,254,919 B2 * 8/2007 Lutz et al. ..... 52/92.2
2007/0193194 A1 * 8/2007 Smith ..... 52/702

* cited by examiner

*Primary Examiner*—Richard E. Chilcot, Jr.
*Assistant Examiner*—Chi Q Nguyen
(74) *Attorney, Agent, or Firm*—Coats & Bennett, P.L.L.C.

(57) ABSTRACT

A joist support structure that is designed to be embedded in a foundation wall. The joist support structure includes an elongated metal V-shaped base that includes a pair of spaced apart legs that extend upwardly from a vertex. Each leg of the V-shaped base includes an upper end portion. Secured to the upper end portion of each leg is a generally U-shaped joist support that comprises a bottom and a pair of spaced apart sides. When the joist support structure is embedded in a concrete block or poured foundation wall, a joist can be seated in the joist supports and supported by the joist support structure, which is in turn supported by the foundation wall.

10 Claims, 3 Drawing Sheets

JOIST SUPPORT STRUCTURE ADAPTED TO BE EMBEDDED INTO A FOUNDATION WALL

FIELD OF THE INVENTION

The present invention relates to static structures, and more particularly to a joist support structure designed to be embedded within a concrete foundation wall.

BACKGROUND OF THE INVENTION

Floor systems utilized in building construction typically include a series of spaced apart joists that are supported directly or indirectly by a foundation wall or foundation piers. These floor joists typically support subfloors and finished floors and are generally attached to a framing structure that overlies the foundation wall or foundation piers. In the case of residential construction, for example, the floor joists take the form of wooden members which are typically nailed, bolted or otherwise secured to a part of a wood framing structure that rests over a foundation wall or other support structure.

While conventional fasteners such as nails, bolts and joist hangars usually provide adequate strength for connecting floor joists to associated building structures, there are occurrences and situations where a more heavy duty structure that is fastened directly to the foundation might provide more strength and safety, especially in cases where a building experiences significant uplifting loads such as might occur during the course of a hurricane.

Therefore, there is a need for a joist support structure that is embedded or otherwise tied directly into the foundation wall.

SUMMARY OF THE INVENTION

The present invention relates to a joist support structure that comprises an elongated metal V-shaped base having a pair of legs that extend upwardly from a vertex. The legs include opposed upper end portions that are spaced above and outwardly from the vertex. Formed on or secured to the upper end of each respective legs is a joist support. Each joist support assumes a generally U-shape and includes a bottom and a pair of spaced apart upstanding sides. When employed, the joist support structure supports a joist by seating the joist in the pair of joist supports such that a bottom portion of the joist rests on the bottom of each joist support and wherein the upstanding sides of each joist support extend upwardly adjacent opposite sides of the joist.

In another embodiment of the present invention, the joist support structure of the present invention is incorporated into a building structure to support a plurality of joists. In this case the building structure includes a foundation wall and a plurality of floor joist supports embedded into the foundation wall. Each joist support structure includes a V-shaped base having a pair of legs and a joist support formed or disposed on upper end portions of each leg. Each joist support assumes a generally U-shape and includes a bottom and a pair of spaced apart upstanding sides. The building structure includes a plurality of joists disposed in the joist supports such that the joists are seated and supported by the respective joist support structures which are in turn embedded and supported within the concrete foundation.

The present invention further entails a method of fabricating a building structure. This method includes building a concrete foundation and embedding a plurality of spaced apart joist support structures into the concrete foundation. In particular, incorporating the joist support structures into the foundation wall includes projecting a dual leg base that forms a part of each joist support structure into the concrete foundation wall such that a pair of joist supports associated with the base are spaced above the concrete foundation wall. Next, joists are seated within the joist supports extending above the foundation such that the joists are supported by the joist support structures and the foundation wall having the joist support structures embedded therein.

Other objects and advantages of the present invention will become apparent and obvious from a study of the following description and the accompanying drawings which are merely illustrative of such invention.

DESCRIPTION OF EXEMPLARY EMBODIMENT

Figure 1:
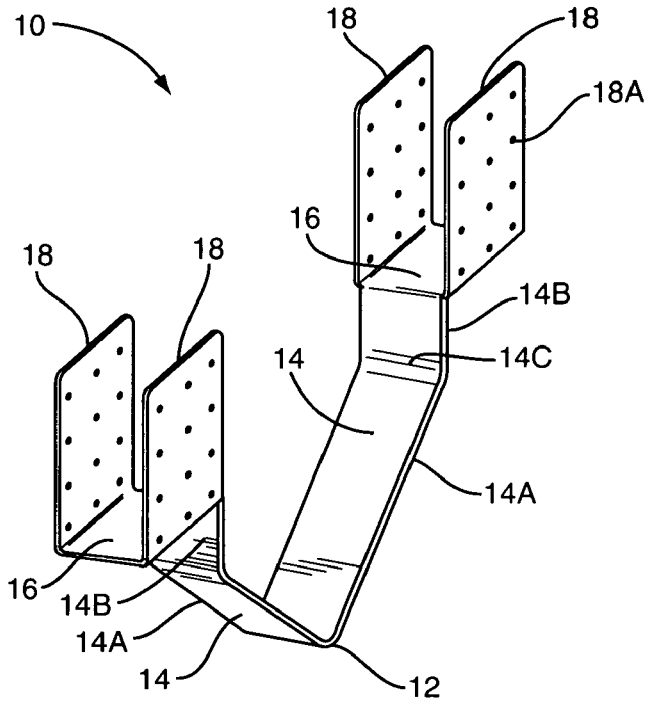
FIG. 1 is a perspective view of the joist support structure.

With further reference to the drawings, particularly FIG. 1, the joist support structure is shown therein and indicated generally by the numeral 10. As will be appreciated from subsequent portions of the disclosure, joist support structure 10 is adapted to be embedded within a concrete foundation wall such that an upper portion thereof lies above the top of the foundation wall and is operative to receive and support a joist that extends from or over the foundation wall.

With particular reference to FIG. 1, the joist support structure 10 includes a base that is preferably constructed of metal. The base assumes, in this embodiment, a generally V-shape. Formed about the lower portion of the base is a vertex 12. Extending upwardly and outwardly from the vertex 12 is a pair of spaced apart legs 14. Note in FIG. 1, for example, that each leg 14 of the joist support structure includes a number of sections. That is, each leg 14 includes a first section 14A that extends upwardly and outwardly from the vertex 12. Then the leg 14 bends and a second section 14B extends generally upwardly from the first section 14A. Formed between the leg sections 14A and 14B is a bend referred to by 14C. It should be pointed out that the shape and configuration of the base and the legs 14 that comprise the base can vary.

Each leg 14 includes an upper portion. Disposed on the upper portion of each base is a joist support. Each joist support assumes a generally U-shape and is supported by a respective leg 14. More particularly, each joist support includes a bottom 16 and a pair of spaced apart sides 18 that project up from the bottom. Formed in the sides 18 is a plurality of openings 18A to receive fasteners such as nails. As seen in FIG. 1, each joist support structure 10 includes a pair of spaced apart joist supports. The two joist supports of each joist support structure 10 are aligned. That is, the bottom 16 and sides 18 of the two joist supports formed on each joist support structure 10 are transversely aligned such that a portion of a joist can be seated in each joist support that forms a part of a single joist support structure.

Figure 2:
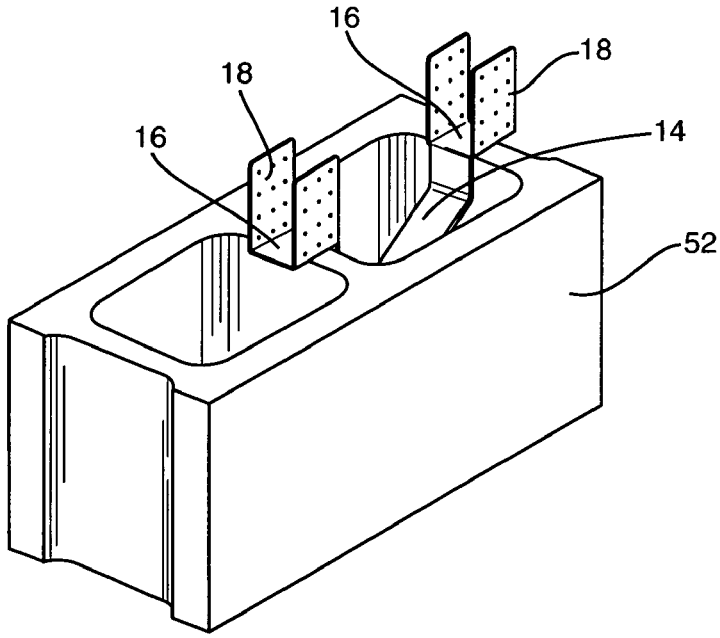
FIG. 2 is a perspective view of a concrete block, utilized in a concrete foundation wall, having the joist support structure of FIG. 1 disposed in a cavity of the block.
Figure 3:
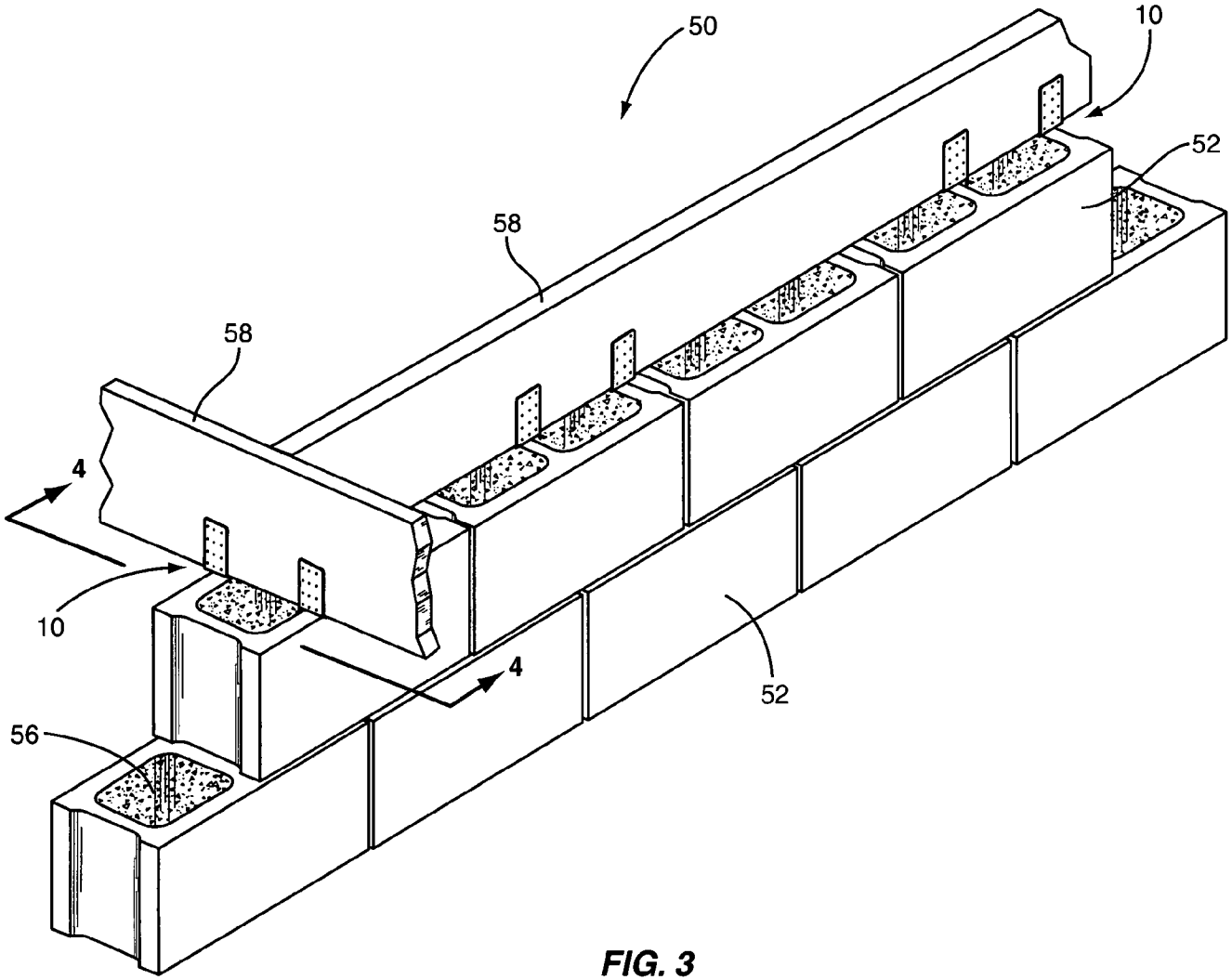
FIG. 3 is a fragmentary perspective view of a portion of a foundation wall having the joist support structures of the present invention embedded within the concrete foundation wall and supporting joists.
Figure 4:
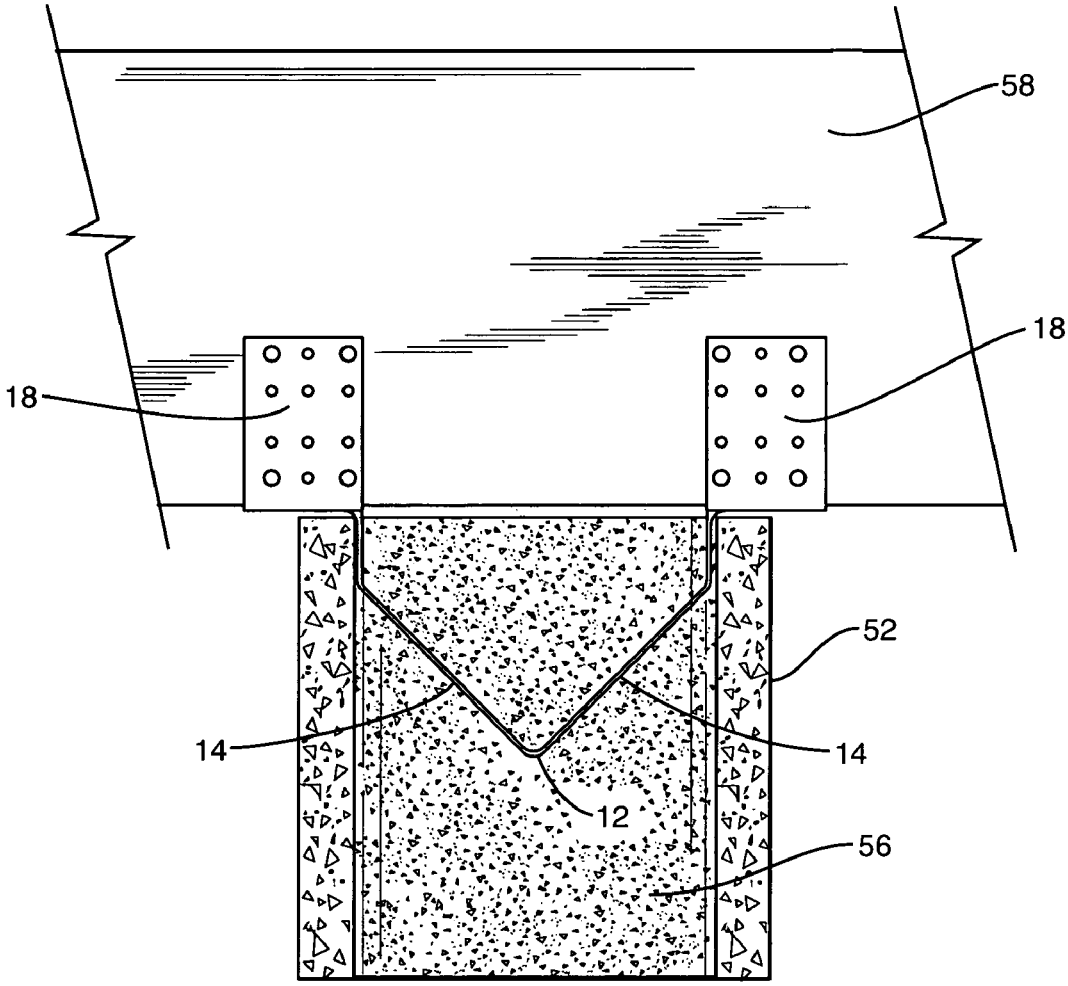
FIG. 4 is a sectional view taken along the lines 4-4 of FIG. 3 showing the joist support structure embedded within a concrete wall.

As discussed above, the joist support structures 10 are designed to be embedded within a foundation wall, such as a concrete foundation wall. Foundation wall structures vary. Most common foundation walls comprise either a series of concrete blocks laid in courses or simply a poured concrete foundation wall. The joist support structure 10 can be utilized with various foundation wall structures including a concrete block foundation wall or a poured foundation wall. FIGS. 2-4 illustrate the joist support structure 10 being embedded within a masonry concrete block foundation wall. FIG. 3 illustrates a concrete block foundation wall made up of a series of concrete blocks 52. Each block has a pair of side-by-side cavities 54. The joist support structure 10 of the present invention is designed to be set into selected cavities 54 in the upper course of the concrete wall. The joist support structure can be oriented in a number of ways within the cavities 54. For example, in FIG. 2, the joist support structure 10 is disposed such that it extends longitudinally of the block 52. That is, the joist support formed on each end of the base is longitudinally aligned with the length of the concrete block 52. In this case the legs 14 can be dimensioned such that their upper sections 14B fit flush against opposed inner walls of the cavities 54. This enables the joist support structure 10 to be quickly and easily stabilized within the cavities 54 even before they are embedded with a concrete fill 56.

In addition, the joist support structures 10 can be sized and dimensioned so as to extend transversely across the block 52. This is illustrated in FIG. 3 where a joist 58 is seated within a joist support structure 10 that is oriented transversely of the concrete block 52.

Note in FIG. 3 where there is shown a pair of wooden joists 58. In one case the wooden joist extends in alignment with the foundation wall and in another case, shown on the lower left hand side of the foundation wall, the wooden joist 58 extends across the foundation wall. In both cases, there is provided at least one joist support structure 10 embedded within a cavity 54 of the concrete wall that supports the joist 58. Joist support structures can assume various alignments with the foundation wall, depending upon the design of the building and the particular loads to be supported. In many situations, in the case of floor joists for example, the joist support structures 10 may be oriented transversely of the respective foundation walls forming a part of a building such that the floor joists 58 extend from one foundation wall to another and which are supported at selected points by one or more joist support structures 10 of the present invention.

FIG. 3 shows the joist support structure 10 being utilized in a concrete block foundation wall. It should be appreciated that the joist support structure 10 can be utilized in a poured foundation wall. After pouring, the joist support structure 10 can be pressed into the liquid or semi-liquid concrete and stationed by attaching them to a part of the forming structure or to an adjacent structure. In addition it may be appropriate to first seat the joist support structure 10 in the forming structure for a concrete wall and then pour the concrete into the forming structure. In this way the concrete will fill the forming structure, and in the process will embed the joist support structures 10 within the concrete wall.

In installing joists such as floor joist 58 shown in FIG. 3, the respective joists are seated within the joist supports situated on the upper ends of the respective legs 14 of each base. As noted before, the sides 18 of the joist support include openings 18 to receive fasteners such as nails. Hence, in the case of wooden floor joists 58 for example, nails can be driven through the openings 18A into the wooden floor joists to securely station the floor joists within the joist support structure 10.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A joist support structure comprising:

a. an elongated metal V-shaped base having a pair of legs joining to form a pointed vertex, wherein the pair of legs extend upwardly from the pointed vertex;

b. each leg including a first leg portion extending generally upwardly and outwardly from the pointed vertex and a second leg portion extending generally vertical from the first leg portion, wherein the first and second leg portions form a bend at an intermediate point such that the first and second leg portions lie in separate planes, and wherein the second leg portions are generally parallel;

c. the legs having opposed upper end portions that are spaced above and outwardly from the pointed vertex;

d. a pair of spaced apart joist supports supported by the V-shaped base, each joist support extending from the upper end portion of a respective leg;

e. each joist support assuming a generally U-shape and including a bottom and a pair of spaced apart upstanding sides; and f. wherein the joist support structure support a joist by seating the joist in the pair of joist supports such that a bottom portion of the joist rests on the bottom of each joist support and wherein the upstanding sides of each joist support extend upwardly adjacent opposite sides of the joist.

2. The joist support structure of claim 1 wherein the V-shaped base includes a relatively narrow band that is bent to form the pointed vertex and wherein each leg is bent at an intermediate point to form first and second leg portions that lie in separate planes.

3. The joist support structure of claim 1 wherein at least one side of each joist support is provided with a plurality of openings for receiving fasteners.

4. The joist support structure of claim 1 wherein the bottom of each joist support extends outwardly from an upper portion of a respective leg and wherein the bottom of each joist support is aligned with both legs of the V-shaped base.

5. The joist support structure of claim 1 wherein the V-shaped base and the joist support are integral in that the V-shaped base and joist supports are formed from a single piece of metal.

6. The joist support structure of claim 1 wherein the V-shaped base includes a length, width and thickness and wherein the thickness is less than the width and the width is less than the length.

7. A building structure comprising:

a. a concrete foundation having a plurality of concrete blocks, wherein each concrete block includes a plurality of cavities;

b. a plurality of joist support structures wherein each joist support structure includes:

i. an elongated metal V-shaped base having a pair of legs that extend upwardly from a pointed vertex;

ii. the legs having opposed upper end portions that are spaced above and outwardly from the pointed vertex;

iii. a pair of spaced apart joist supports supported by the V-shaped base, each joist support extending from the upper end portion of a respective leg;

iv. each joist support assuming a generally U-shape and including a bottom and a pair of spaced apart upstanding sides;

v. wherein the joist support structure support a joist by seating the joist in the pair of joist supports such that a bottom portion of the joist rests on the bottom of each joist support and wherein the upstanding sides of each joist support extend upwardly adjacent opposite sides of the joist;

c. at least a portion of each V-shaped base of each joist support structure is embedded in one of the cavities in one of the concrete blocks and spaced therein such that at least a portion of the joist supports lie above a top of the concrete block; and d. a plurality of joists seated in the joist supports of the respective joist support structures such that the joists are seated and supported by the joist support structures which are in turn embedded and supported within the concrete blocks.

8. The building structure of claim 7 wherein the V-shaped base of the joist support structures are projected downwardly into the cavities of the concrete blocks and wherein a concrete fill is contained within the cavities of the concrete blocks and extends around and embeds the V-shaped bases into the foundation.

9. A method of fabricating a building structure comprising:

a. building a concrete foundation wall;

b. embedding a plurality of spaced apart joist support structures into the concrete foundation wall by downwardly projecting a V-shaped dual leg base that forms a part of the respective joist support structures into the concrete foundation and spacing one or more joist supports supported by the base above the foundation wall, the joist support structure comprising:

i. the V-shaped dual leg base, wherein each leg extends upwardly from a pointed vertex;

ii. the legs having opposed upper end portions that are spaced above and outwardly from the pointed vertex;

iii. each leg including first and second leg portions, wherein the second leg portions extend generally vertical from respective first leg portions;

iv. a pair of spaced apart joist supports supported by the base, each joist support extending from an upper end portion of a respective leg;

v. each joist support assuming a generally U-shape and including a bottom and a pair of spaced apart upstanding sides; and c. seating joists into the joist supports extending above the foundation wall such that the joist are supported by the joist support structure and the foundation wall having the joist support structures embedded therein.

10. The method of claim 9 wherein the joist support structure includes a pair of spaced apart joist supports with each joist support connected to an upper portion of one of the legs of the dual leg base, and wherein each joist support includes a bottom and a pair of laterally spaced sides that define a U-shaped seat for receiving the joist.

* * * * *